US008147662B2

(12) United States Patent
Dufresne

(10) Patent No.: US 8,147,662 B2
(45) Date of Patent: Apr. 3, 2012

(54) CAPPING BOARD SECTION AND ASSEMBLY WITH REINFORCED MATING PROJECTION

(75) Inventor: Robert Dufresne, Saint-Bruno (CA)

(73) Assignee: Pultrusion Technique Inc., St-Bruno (CA)

( * ) Notice: Subject to any disclaimer, the term of this patent is extended or adjusted under 35 U.S.C. 154(b) by 302 days.

(21) Appl. No.: 12/524,852

(22) PCT Filed: Jan. 29, 2008

(86) PCT No.: PCT/CA2008/000181
§ 371 (c)(1),
(2), (4) Date: Oct. 20, 2009

(87) PCT Pub. No.: WO2008/092248
PCT Pub. Date: Aug. 7, 2008

(65) Prior Publication Data

US 2010/0065423 A1 Mar. 18, 2010

Related U.S. Application Data

(60) Provisional application No. 60/897,816, filed on Jan. 29, 2007.

(51) Int. Cl.
*C25B 9/02* (2006.01)

(52) U.S. Cl. ..... 204/279; 204/281; 204/286.1; 204/278.5; 204/288.1; 204/288.2; 204/297.01; 204/267

(58) Field of Classification Search ..... 204/279, 204/281, 286.1, 267, 278.5, 288.1, 288.2, 204/297.01
See application file for complete search history.

(56) References Cited

U.S. PATENT DOCUMENTS

| | | | | |
|---|---|---|---|---|
| 3,697,404 | A * | 10/1972 | Paige | 204/267 |
| 4,213,842 | A | 7/1980 | Dufresne | |
| 5,645,701 | A * | 7/1997 | Dufresne et al. | 204/297.01 |
| 6,342,136 | B1 | 1/2002 | Virtanen | |
| 7,204,919 | B2 * | 4/2007 | Dufresne | 204/279 |
| 7,223,324 | B2 * | 5/2007 | Dufresne | 204/279 |
| 7,854,825 | B2 * | 12/2010 | Ebert | 204/297.01 |

FOREIGN PATENT DOCUMENTS

| | | | |
|---|---|---|---|
| CA | 2171412 | A1 | 3/1997 |
| EP | 0121509 | A1 | 10/1984 |

* cited by examiner

*Primary Examiner* — Bruce Bell
(74) *Attorney, Agent, or Firm* — Baker & Hostetler LLP

(57) ABSTRACT

The invention concerns a capping board assembly and its multiple connectable sections. Each pair of sections is connected with an interlocking joint, each of which comprises at least one projection and at least one recess that cooperate and prevent the longitudinal and lateral movement of the sections. Each interlocking joint is reinforced by a rod embedded within the section and extending within the projection. The rod has a tip that anchors the projection. The interlocking joints allow precision assembly of the sections of the capping board which greatly benefits strength, installation, replacement and transportation.

39 Claims, 7 Drawing Sheets

CAPPING BOARD SECTION AND ASSEMBLY WITH REINFORCED MATING PROJECTION

CROSS-REFERENCE TO RELATED APPLICATIONS

This application is a National Stage of International patent application PCT/CA2008/000181, filed on Jan. 29, 2008, which claims priority to U.S. provisional patent application 60/897,816, filed on Jan. 29, 2007, the disclosures of which are incorporated herein by reference in their entirety.

FIELD OF THE INVENTION

The present invention relates to the field of capping boards, and more specifically to connectable capping board sections. The invention also relates to the field of processes for manufacturing capping board sections and assemblies.

BACKGROUND OF THE INVENTION

In the hydrometallurgical industry, it is of common practice to refine metal by electrolysis in electrolytic cells especially designed for this purpose. The metals that are refined are usually conventional metals like copper, zinc, nickel or cadmium, or precious metals like silver, platinum or gold, and others.

It is also of common practice to use metal plates as anodes or cathodes or both. These metal plates most often weigh several hundred pounds, have a given thickness and include the metal to be refined or used to carry the electric current. Once installed, the plates usually hang on lateral sidewalls of the electrolytic cells. In use, these heavy plates are immersed into the cells in parallel relationship and are used as anodes, cathodes or both, depending on the affinity and properties of the metal being refined.

In order to precisely and properly position the electrodes, it is of common practice to place a member called a "capping board" onto the top surface of each lateral sidewall of the cells. These capping boards are used to position the plates with respect to each other. They are also used as electric insulators between adjacent cells and/or each electrode and/or the ground.

In practice, the capping boards are used not only as supports to position the electrodes, but also as supports to avoid damage to the masonry or concrete forming the lateral sidewalls of the cells during the insertion and removal of the heavy electrodes.

As examples of such capping boards and the way they can be manufactured, reference can be made to U.S. Pat. No. 4,213,842 (DUFRESNE) and Canadian patent No. 1,102,737 (DUFRESNE). Reference can also be made to U.S. Pat. No. 5,645,701 (DUFRESNE).

As other examples of such capping boards, reference can also be made to U.S. Pat. No. 3,697,404 (PAIGE) and to U.S. Pat. No. 6,342,136 (OUTOKUMPU OY).

As mentioned hereinabove, the insulating capping boards are used to hold the electrodes at very precise positions. They are also often used in combination with other components of the electrolytic apparatus, such as electrically conductive contact bars whose purpose is to allow electrical connection between the ends of the anodes and cathodes located in the adjacent cells. Thus, the combined use of capping boards and contact bars has the particularity of allowing insulation and distribution of electric current at the same time. The capping boards may also be precisely arranged in relation to other components, depending on the specific electrolytic process or cell arrangement.

The installation of capping boards also presents numerous difficulties, as both the capping boards and the electrical plates are often large, heavy and awkward to handle. In addition, the precision fit of the capping board with respect to the plate and cell dimensions requires certain manufacturing standards and implies certain limits on the form and construction of the capping board. Other disadvantages of known capping boards, especially concerning the transport, replacement, maintenance and installation thereof, are a burden on the industry and are known to a person skilled in the art.

FIGS. 1*a* (Prior Art) and 1*b* (Prior Art) illustrate two examples of known capping boards. FIG. 1*a* (Prior Art) illustrates a part of a capping board 10 known in the art, which is cast in a single piece having the length of the vertical sidewalls of the electrolytic cells on which they lie. This length usually ranges from ten to twenty six feet depending on the size of the electrolytic cell. This capping board 10 includes two rows of separation walls 12, whose shapes are cooperable with the projections of the electrodes (not illustrated). The walls 12 define various compartments 14 of different depths, in order to receive the electrodes. In this case, the walls 12 of the respective rows are longitudinally staggered, as required for precise and proper fit with the electrodes of that particular arrangement.

FIG. 1*b* (Prior Art) illustrates a different construction of part of a capping board 10. In this case, the walls 12 are in two parallel rows, yet they are not staggered longitudinally but are staggered vertically (different depths). There is also a central longitudinal wall 16 separating the compartments 14. FIG. 1*b* also shows pultruded bars 18 that have been embedded within the capping board material. These bars 18 act as reinforcement of the resin, and may be made of fiber-reinforced polymers. One or more of the bars 18 may be embedded within the resin.

Capping boards have also been assembled from sections. Such sections may be connected by a male-female joint. The male part of one section has a shape that flares outward while the female part of another section may receive the male part to connect the two sections and form an assembled capping board. Such sections and assemblies known in the art have presented certain disadvantages including the weak structure of the male parts and/or the precision with which the male and female parts fit together.

There is thus a current need in the industry for a capping board technology that would overcome at least some of the disadvantages of the prior art.

SUMMARY OF THE INVENTION

The present invention responds to the above-mentioned need by providing a capping board assembly and section as well as a process for manufacturing such a section.

More specifically, the invention provides a capping board assembly for use in an electrolytic cell, including at least two capping board sections, each having a main body molded of a resin material. One of the sections has at least one projection extending longitudinally outward from the main body thereof, and has a reinforcement member embedded at least partially within the main body and the corresponding projection. The other of the sections has at least one recess provided at an extremity of the main body thereof, each recess mating with the corresponding projection to thereby secure the capping board sections in a functional arrangement.

In one preferred embodiment of the capping board assembly, one of the at least one projections and the corresponding recess have corresponding shapes enabling the projection to completely fill the corresponding recess when mated therewith.

In another preferred embodiment of the capping board assembly, the at least one projection of one of the sections comprises two projections in spaced relation to each other and defining a recess therebetween, said recess mating with a corresponding projection of the other section, each of the projections having a corresponding reinforcement member at least partially embedded therein. Preferably, each of the reinforcement members comprises an elongate portion and a tip, the elongate portion being at least partially located in the corresponding main body and the tip being at least partially located in a corresponding one of the at least one projection, the tip being wider than the elongate portion. Preferably, the tip has a dovetail shape. Also preferably, once the two sections are assembled, the tip of the reinforcement member of one of the sections longitudinally overlaps the tip of the other of the sections. Also preferably, the two projections comprise a center projection extending from between the lateral edges of the main body and an edge projection aligned with one of the lateral edges of the main body.

In another preferred embodiment of the capping board assembly, the at least two sections comprise three sections that are assembled longitudinally in series by mating the projections with the corresponding recesses.

The invention also provides a capping board section for use in an electrolytic cell, including a main body molded of a resin material and at least one projection extending longitudinally outward from the main body, each projection being for mating with a corresponding recess of an element of the electrolytic cell, for securing the capping board section in a functional arrangement. The section also includes a reinforcement member embedded at least partially within the main body and one of the at least one projection.

In one preferred embodiment of the capping board section, the element with which the projection may mate is an other capping board section and assembling the capping board sections results in a capping board assembly. Such a capping board assembly may be as defined hereinabove.

In another preferred embodiment of the capping board section, the reinforcement member includes an elongate portion and a tip, the elongate portion being at least partially located in the main body and the tip being at least partially located in the projection, the tip being wider than the elongate portion. Preferably, the tip is outwardly tapered extending away from the main body and is preferably dovetail shaped. Also preferably, the tip has a multiple dovetail shape. Also preferably, the multiple dovetail shaped tip is at least partially located within the main body. Preferably, the tip is composed of epoxy, polyester, vinyl ester, acrylic, polyphenilene sulphide-based alloys, polyurethane or thermoset resins, or combinations thereof. Preferably, the elongate portion is straight and extends along the entire length of the main body. The elongate portion may be made of pultruded resin material reinforced with glass or cizal fibers or a combination thereof. The resin material of which the main body is composed may be polytetrafluoroehtylene, polyester, vinylester, polyurethane, polyphenilene sulphide-based alloys, phenolic resins or a combination thereof.

In another preferred embodiment of the capping board section, each of the at least one projection has a shape wherein it is wider at a location further away from the main body. Preferably, each of the at least one projection is dovetail shaped. Preferably, the at least one projection includes first and second projections extending in spaced relation to each other to define a recess therebetween, said recess being matable with a corresponding projection of the other capping board, each of said first and second projections having a corresponding reinforcement member embedded therein.

In another preferred embodiment of the capping board section, the at least one projection is integral with the main body and is composed of the same resin material thereof. Preferably, the reinforcement member is entirely covered by the resin material.

The present invention also provides a process a process for manufacturing at least one capping board section including the steps of:

a) providing a resin for molding;

b) embedding at least one reinforcement member within the resin; and c) molding the capping board section from the resin so as to comprise a main body and at least one projection extending longitudinally outward from the main body, and so that each reinforcement member is located at least partially within the main body and the corresponding projection.

In one preferred embodiment of the process, there is an additional step performed after step a), which includes embedding and/or wetting some reinforcement fibers within the resin. Still preferably this is done before step b).

The present invention and its various aspects will be better understood upon reading the following non restrictive description made with reference to the drawings.

DETAILED DESCRIPTION

Capping boards may take on a variety of forms and sizes according to the desired application as well as the specifications of the electrical plates and cells with which they are used. When assembled, the present invention may have the form and function of various types capping boards known in the art, some of which are described below and illustrated in the Figs. The particular arrangement of the projection(s) and recess(es) may be adapted according to the position of other elements of the capping board, such as the separating walls, the compartments, embedded elements, etc.

Capping Board Assembly

Figure 1A:
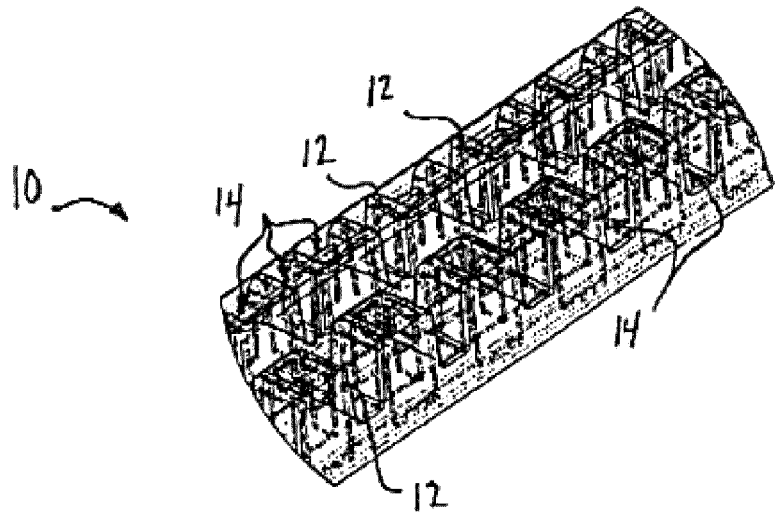
FIG. 1A (Prior Art)
FIG. 1*a* identified as "Prior Art" is a transparent perspective view of part of one type of known capping board.
Figure 1B:
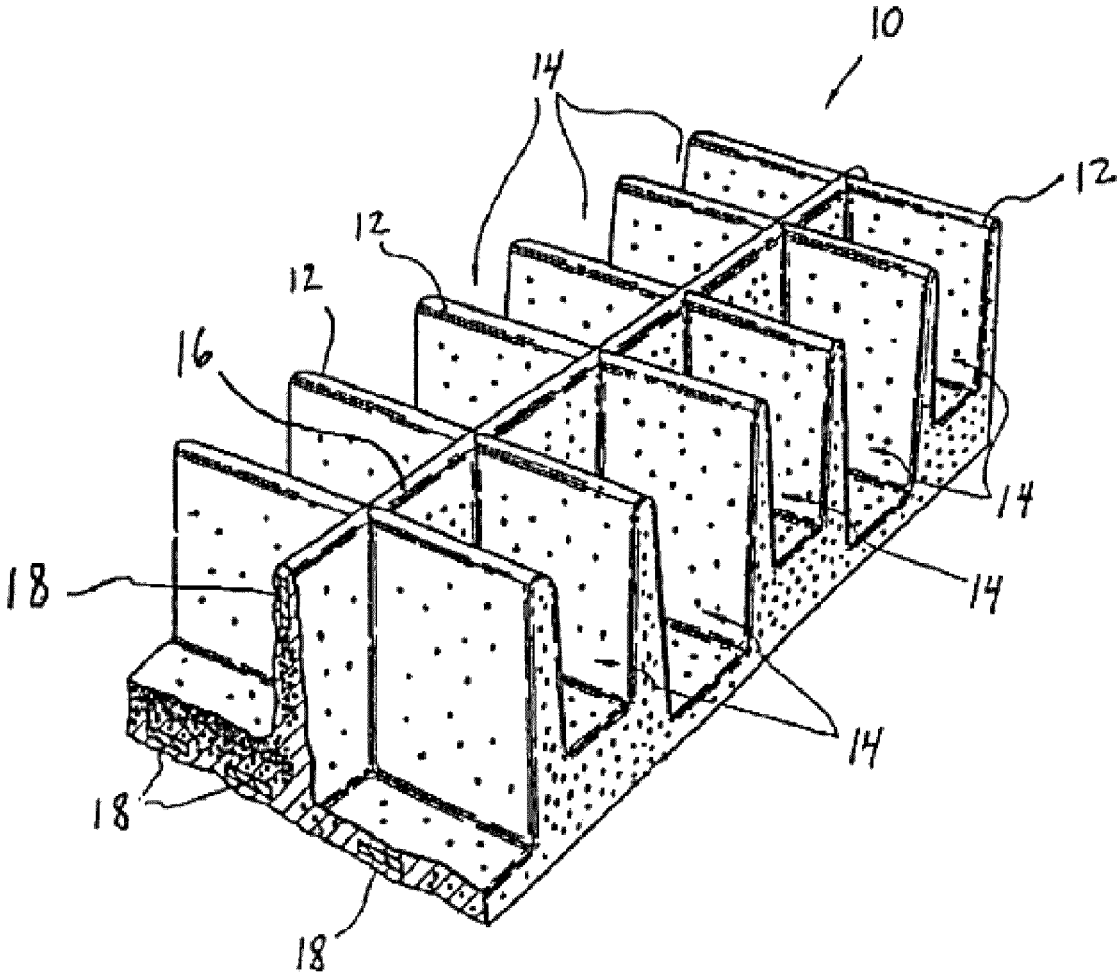
FIG. 1B (Prior Art)
FIG. 1*b* identified as "Prior Art" is a perspective view of a part of another type of known capping board.
Figure 2:
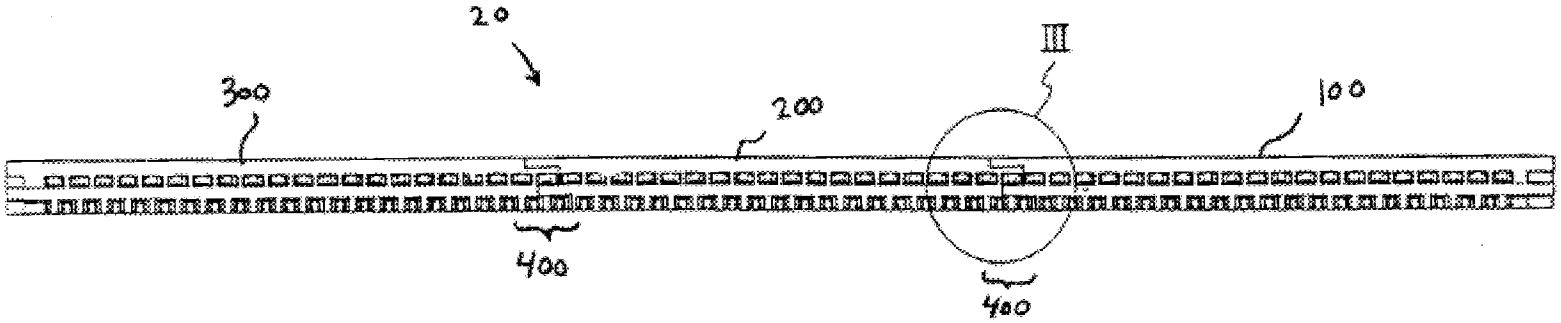
FIG. 2 is a top plan view of a capping board assembly according to an embodiment of the present invention.

FIG. 2 illustrates a capping board assembly 20 according to one embodiment of the present invention. As illustrated, this capping board assembly 20 includes three sections, identified hereafter as first 100, second 200 and third 300 sections. In this illustrated embodiment, the first 100 and third 300 sections are end sections and the second section 200 is a middle section. It should be noted that the assembly 20 should have at least two sections. FIG. 2 illustrates an embodiment of the capping board assembly when applied to the capping board type of FIG. 1*a* (Prior Art), but it should be understood that the type of FIG. 1*b* as well as other types of capping boards may also be used in conjunction with embodiments of the present invention. Also, the capping board assembly 20 may include more sections, when desired.

Figure 3:
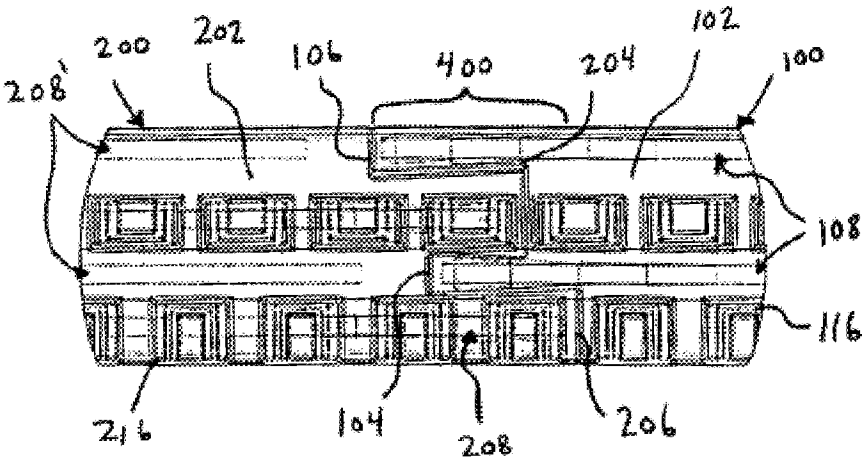
FIG. 3 is a close-up top plan transparent view of area III of FIG. 2 showing the mating of two capping board sections and in dotted lines part of the reinforcement members, according to an embodiment of the present invention.

Referring now to FIG. 3, the first section 100 and the second section 200 each have a main body 102,202 which is molded using a resin material. The resin material for forming the capping board sections 100,200 is preferably selected from the group consisting of polytetrafluoroethylene, polyester, polyurethanes, polyvinylester, epoxy, polyphenilene sulphide-based alloys and phenolic resins, and blends or alloys of the same. The resin is preferably reinforced by impregnating it with fibers.

In this illustrated embodiment, the first section 100 has two projections 104,106 extending longitudinally outward from the main body 102 thereof. There is a reinforcement member 108 embedded at least partially within the main body and the corresponding projections 104,106. The second section 200 also has two projections 204,206 extending longitudinally outward from the main body 202 thereof and has reinforcement members 208 embedded within the main body 202 and the projections 206,204.

Figure 11:
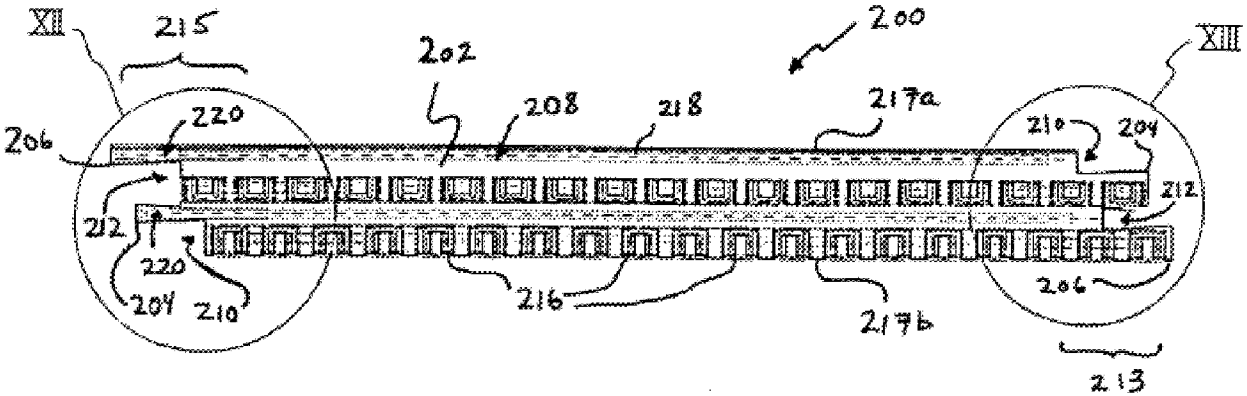
FIG. 11 is a top plan transparent view of a middle capping board section according to an embodiment of the present invention.

Referring briefly to FIG. 11, the second section 200 has corresponding recesses 210,212 provided at one extremity 213 of the main body 202, each recess 210,212 mating with the corresponding projection of the first section.

Referring back to FIG. 3, when assembled by mating the projections to the corresponding recesses, the sections 100, 200 are secured together in a functional arrangement. The projections are reinforced by the reinforcement members 108,208. The capping board assembly may then be mounted to the electrolytic cell (not shown).

As illustrated in FIG. 2, there may be a plurality of sections 100,200,300 that are assembled together to form an assembly 20. Alternatively, a capping board section provided with a projection reinforced with a reinforcement member may be mounted to an element of an electrolytic cell to anchor the section to the cell. Thus, in this optional embodiment, one capping board section may be provided and secured to the electrolytic cell in a precise and functional fashion.

Referring to FIG. 3, when assembled, the first 100 and second 200 sections thus form an interlocking joint 400 to connect the sections together in a coplanar fashion to form the assembled capping board 20.

For the embodiments of FIGS. 2-13, the interlocking joint 400 includes at least one projection a corresponding recess. Considering FIG. 3, the projection 104 is matable within the recess of the second section 200 to hold the sections 100,200 together by resisting longitudinal and lateral movement of the sections 100,200 relative to each other. Various shapes of projections and recesses may be provided in order that proper mating occurs.

Figure 14:
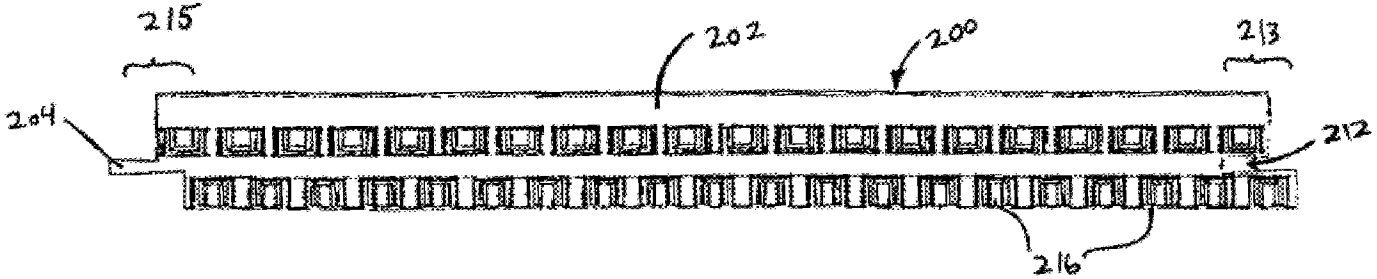
FIG. 14 is a top plan view of a middle capping board section according to another embodiment of the present invention.

Referring now to FIG. 14, showing another embodiment of the middle section 200, there may be one recess 212 provided at one extremity 213 and one projection 204 provided at the opposite extremity 215. The other sections (not shown here) are provided with corresponding projection or recess arrangements to form interlocking joints.

Referring back to FIG. 3, the interlocking joint 400 is preferably molded to a predetermined shape according to the specifications of the electrolytic cell and electrodes with which it is to be used. The abutment edge between the projections 104,106,204,206 and recesses zigzags around the seats 116,216 of the capping board sections 100,200. This facilitates adapting existing molding equipment in order to form different sections 100,200 of the capping board 20 and enables the seats 116,216 to remain intact and distinct from the joint edge. More regarding the manufacture of the capping board sections 100,200,300 will be discussed hereinbelow.

As illustrated in FIG. 3, the interlocking joint 400 preferably includes a plurality of projections 104,106,204,206. In this embodiment, each of the projections has a dovetail shape and each recess precisely corresponds to that shape. Thus, the projections 104,204 may be inserted vertically into the corresponding recesses, and have a secure connection, especially in the longitudinal and lateral directions. Each projection preferably has a shape wherein it is wider at a location further away from the main body. Preferably, the projections are dovetail shaped. It should be noted, however, that the projections and recesses may also have other shapes, such as double-dovetail, multiple-dovetail, or T-shape and the dovetail may have sides that are straight, convex or concave. Other shapes allowing vertical insertion and longitudinal and lateral securing are also possible.

The projections and recesses preferably have mating shapes (e.g. dovetail shape) viewed from the top surface of the capping board sections, but alternatively may have mating shapes as viewed from another angle, thereby enabling the sections to engage each other from another direction.

Figure 7:
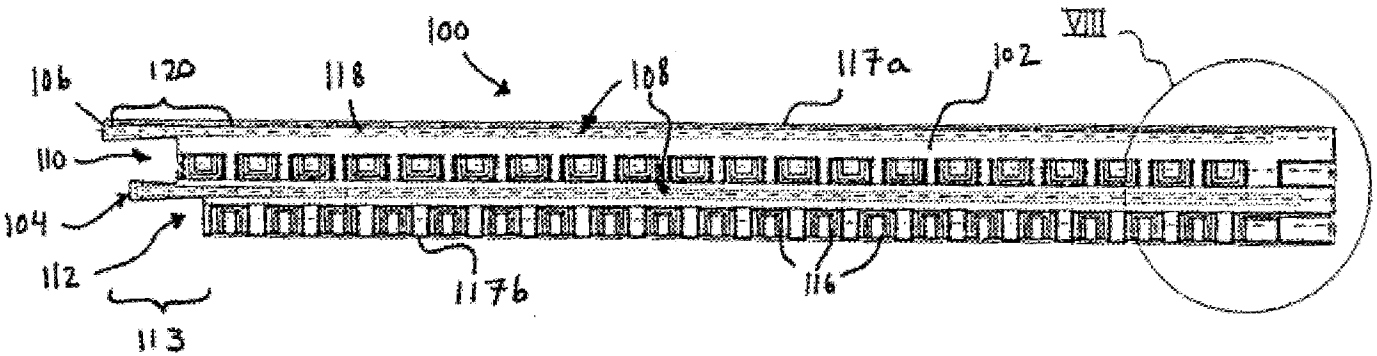
FIG. 7 is a top plan transparent view of an end capping board section according to an embodiment of the present invention.

As illustrated in FIG. 7, the first section 100 has at one of its extremities 113 two projections 104,106 in spaced relation to each other and defining a center recess 110 therebetween. The two projections may be called a center projection 104 that extends from in between the lateral edges 117*a*,117*b* of the section 100 and an edge projection 106 that has one side aligned with a lateral edge 117*b* of the section 100. The center recess 113 may mate with a corresponding projection of the third section. Each of the projections 104,106 preferably has a corresponding reinforcement member 108 at least partially embedded therein.

FIG. 11 illustrates that the projections 204,206 may be located in an arrangement to accommodate the compartments 216. Furthermore, the projections 204,206 locate on a same extremity of the section 200 may be in a staggered relationship with respect to each other to aid in the strength and precision of the joint. Also, the edge projections 206 of opposing extremities 213,215 of the section 200 are preferably on opposite lateral edges 217*a*,217*b*, so as to further aid the precision fit of the second section 200 with respect to the first and third sections. The opposite edge projections may alternatively have other arrangements.

Figure 12:
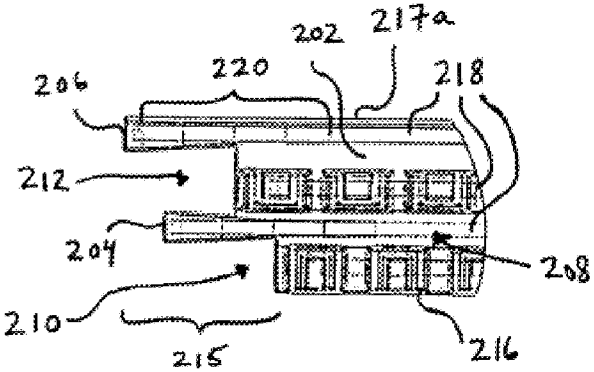
FIG. 12 is a close-up top plan transparent view of area XII of FIG. 11, showing one extremity of that capping board section.

Referring now to FIGS. 11 and 12, which illustrate the second section 200, an embodiment of the reinforcement member will be discussed as it applies to any of the sections. In these Figs, the reinforcement member 208 includes an elongate portion 218 and a tip 220. The elongate portion 218 may be composed of pultruded resin impregnated with glass or cizal fibers.

Figure 15:
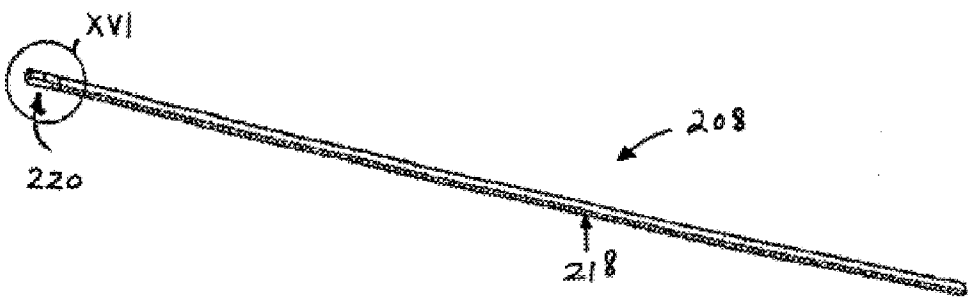
FIG. 15 is a perspective view of a reinforcement member according to an embodiment of the present invention.
Figure 16:
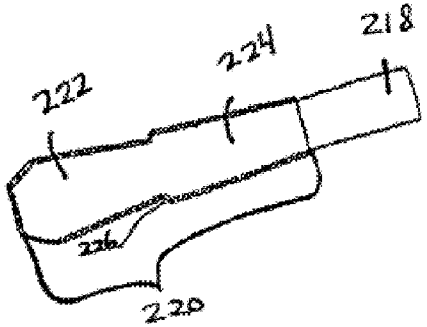
FIG. 16 is a plan view of area XVI of FIG. 15, showing a tip of that reinforcement member according to an embodiment of the present invention.

Referring now to FIGS. 15 and 16, another embodiment of the reinforcement member 208 is illustrated. The reinforcement member 208 may also take another shape to reinforce the interlocking joint, and may have various orientations to improve the interlocking of the two sections. In the embodiment of FIGS. 15 and 16, the tip has a dovetail shape viewed from above, whereas the embodiments of FIGS. 3-13, the tips have dovetail shapes viewed from the side and from above.

The resin for forming the elongate portion 218 is preferably selected from the group consisting of polyester, vinylester, polyurethanes, epoxy, polyphenilene sulphide-based alloys and phenolic resins and blends or alloys of the same. The fibers are preferably selected from the group consisting of glass fibers, cizal fibers, resin fiber such as Kevlar® fibers. Of course, other materials known to a person skilled in the art may be used. For instance, the reinforcement members 208 may alternatively be made of wood, stone and/or another insulating material. The reinforcement members 208 may also be made from a combination of materials, mixed together or adhered to one another.

Preferring to FIGS. 11 and 12, the tip 220 is disposed at the end of the elongate portion 218, and parts of the tip 220 extend outward from the elongate portion 218. Preferably, the tip 220 is dovetail shaped or, still preferably, multiple-dovetail shaped as illustrated. It may be composed of epoxy, polyester, vinylester, polyurethanes, polyphenilene sulphide-based alloys and phenolic resins and blends or alloys of the same or another appropriate material. The tip 220 may alternatively have another form suitable for reinforcing the projection and/or improving the interlocking joint, such as a T-shape or hook-shape. Preferably, the shape of the tip 220 substantially corresponds with the shape of the projection.

The tip 220 may also be integral with the rest of elongate member 218, or adhered thereto. It may also be made of various hard polymeric materials, or another suitable material known to a skilled workman. The tip 220 is notably useful for preventing the reinforcement member 208 from slipping within the base of the capping board section 200 in which it is provided, strengthening the projection 204,206 and, in turn, improving the strength, precision and durability of the interlocking joint.

Referring to FIG. 16, the tip 220 may be double-dovetail shaped, wherein the further dovetail part 222 is wider than the closer dovetail part 224. The double- or multiple-dovetail shapes provide one or more stop edges 226 aiding the embedding and precision of the reinforcement.

The tip 220 may have a rounded or straight end. When it has a multiple-dovetail shape, the first dovetail has a certain angle and the second dovetail 36 may have the same or different angle. The tip 220 is especially capable of reinforcing and increasing the stability of the interlocking joint in the longitudinal direction.

The reinforcement members 208 are preferably added to the capping board section 200 resin while the latter is still in liquid form, before curing. They preferably extend the length of the section 200, but may alternatively extend only slightly within the main body to fortify the projection with respect thereto.

The reinforcement member 208 increases the strength of the projections 204,206 especially in the lateral and vertical directions.

Figure 4:
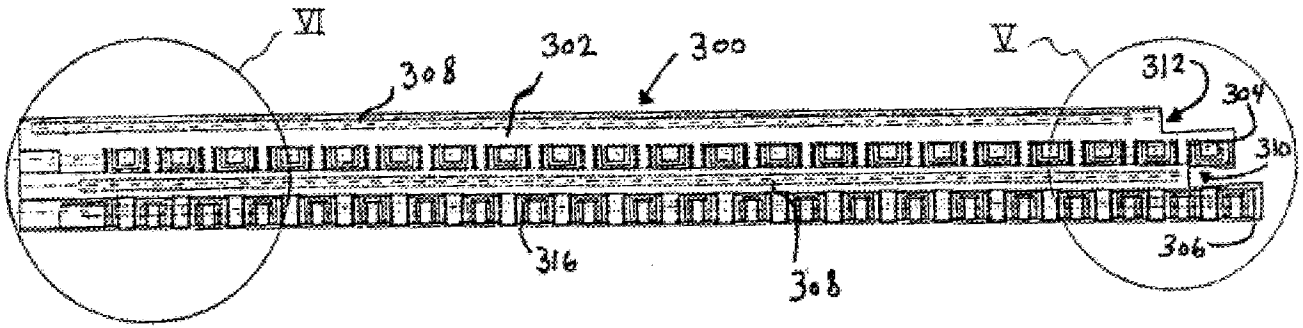
FIG. 4 is a top plan transparent view of an end capping board section according to an embodiment of the present invention.

Referring to FIGS. 4, 7 and 11, the reinforcement members 108,208,308 bestow a variety of advantageous properties upon the capping board sections 100,200,300 and assembly. For instance, they add rigidity to the main body 102,202,302 of each section and also rigidify the projections 104,106,204,206,304,306 themselves as well as in relation to the respective main bodies. The reinforcement members 108,208,308 also stabilize the interlocking joint and permit a high level of precision in the joint. The strength of the interlocking joint of the sections and of the capping board assembly is ameliorated. Also, incorporating reinforcement members into the sections enables the reduction of the amount of resin, fibers and additives needed to produce a desired shape of the capping board assembly.

In one embodiment of the reinforcement member 208 illustrated in FIG. 11, the dovetail shaped tip 220 enables the reinforcement members 208 to be well anchored within the section 200 and provides good resistance to relative movement between the sections. Also, the corresponding shape between the tip 220 and the projection 206 (i.e. dovetail-like shape) promotes the strength, rigidity and precision of the interlocking joint.

In the preferred embodiment illustrated in FIG. 3, the first 100 and second 200 sections are each provided with two reinforcement members 108,208 extending from their respective main bodies 102,202 into two respective projections 104,106,204,206. Also, there are two illustrated reinforcement members 208' that have an extremity proximate the recesses of the second section 200. When assembled, the first projections 104,106 are adjacent to the second projections 204,206 and the reinforcement members 108,208 thus overlap longitudinally. This overlapping further improves the interlocking joint 400, by increasing the resistance of relative movement between the sections while augmenting the precision and strength of the joint 400.

Figure 6:
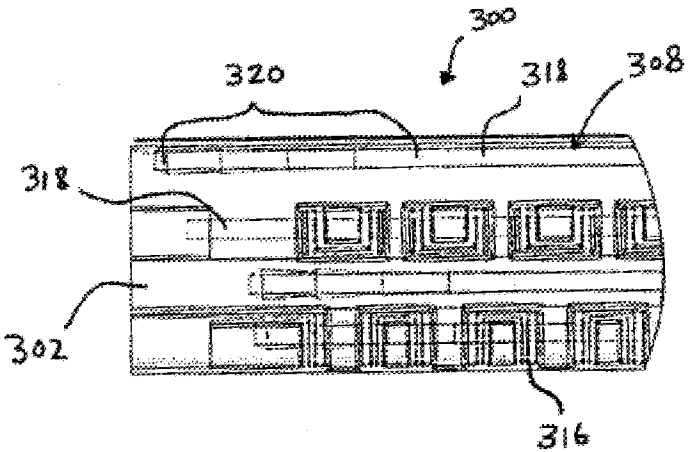
FIG. 6 is a close-up top plan transparent view of area VI of FIG. 4, showing the extremity of that capping board section opposite the extremity of FIG. 5.
Figure 5:
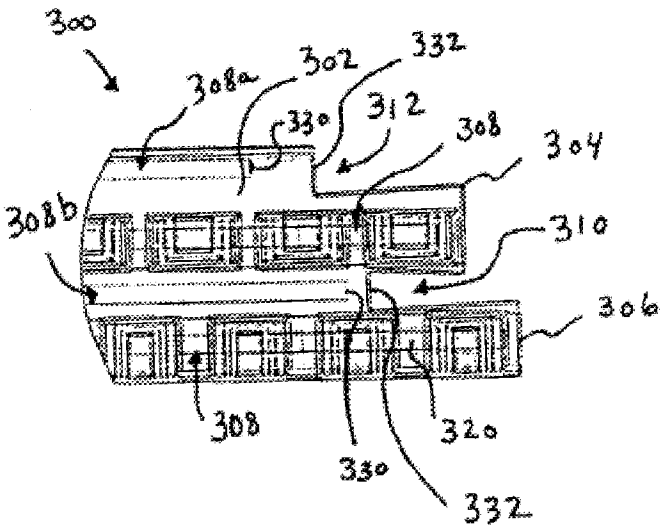
FIG. 5 is a close-up top plan transparent view of area V of FIG. 4, showing one extremity of that capping board section.

Referring to FIGS. 4-6, the third section 300 includes four reinforcement members 308 embedded therein based on the number of projections to reinforce. Of course, there may be more or less reinforcement members. For instance, one or more reinforcement members may be used for a single projection. FIG. 5 shows that tips 320 are provided within the projections 304,306 and the main body 302. Also, each of the reinforcement members 308*a*,308*b* have an end 330 proximate the inner edge 332 of the recesses 312,310, which may aid in the solidity thereof. FIG. 6 shows that the tips 320 may also be provided where there are no projections. When tips are provided at both ends of the reinforcement member, this may further fix the reinforcement relative to the resin of the main body and the projections.

Figure 8:
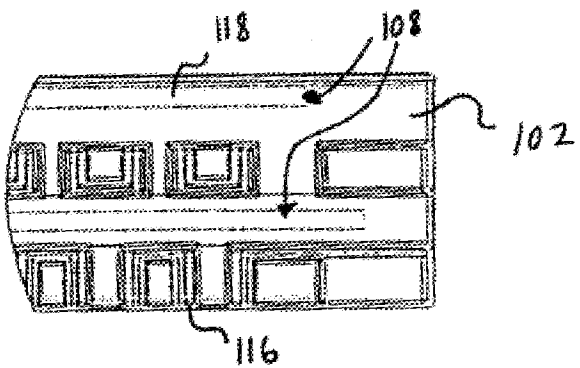
FIG. 8 is a close-up top plan transparent view of area VIII of FIG. 7, showing one extremity of that capping board section.

Referring to FIGS. 7-8, the first section 100 includes two reinforcement members 108 embedded therein. Alternatively, this section 100 may include four or six reinforcement members as shown and described for the third section.

Figure 13:
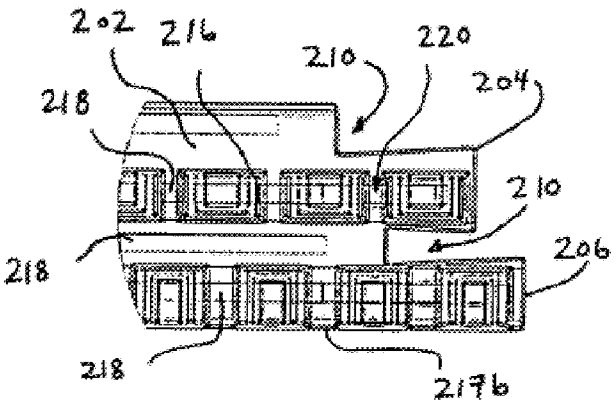
FIG. 13 is a close-up top plan transparent view of area XIII of FIG. 11, showing the extremity of that capping board section opposite the extremity of FIG. 12.

Referring to FIGS. 11-13, the second section 200 includes four reinforcement members 208, although more or less may also be used as was mentioned above. A tip 220 is preferably provided within each of the projections 204,206.

Figure 9:
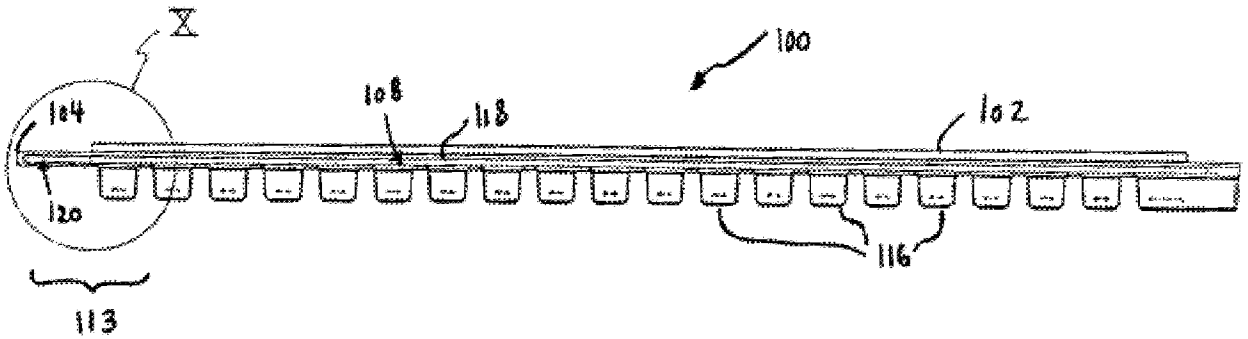
FIG. 9 is a side plan cut view of the capping board section of FIG. 7.
Figure 10:
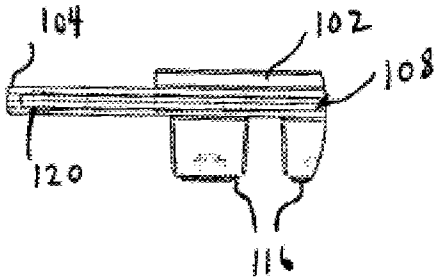
FIG. 10 is a close-up side plan cut view of area X of FIG. 9, showing one extremity of that capping board section and in dotted lines part of a reinforcement member.

Referring now to FIGS. 9 and 10, the tip 120 of the reinforcement member 108 may also be dovetail-shaped when viewed from the side to further aid the precision and reinforcement of the interlocking joint.

Furthermore, referring to FIGS. 3-5, 7 and 9-13, the relative size of the reinforcement member and its tip may be observed for these embodiments. However, the tips and members may be of various sizes enabling the capping board section to be functional in the given electrolytic cell.

The interlocking joint enabled by the reinforced projection (s) of embodiments of the present invention enables a high level of precision regarding the connection of sections 100, 200,300 of a same capping board assembly 20, reducing or eliminating the possible displacement of one section with respect to another. This gives rise to a plethora of advantages that would be appreciable by a person skilled in the art. For instance, different sections may be manufactured and/or sold separately and transported in bundles or separately rather than in single lengthy pieces. Installation is also greatly facilitated, especially when the cell or plate geometry makes it difficult or cumbersome to install a capping board as a single piece. In addition, replacement of used capping boards may be ameliorated, and in the case where only one section is subject to a higher rate of wearing or physical or chemical degradation, it may in some instances be replaced with a new section rather than replacing the entire capping board. Also, the capping board assemblies are less susceptible to mechanical stress and damage, especially in the interlocking joint region.

The preferred manufacturing process of a capping board section, for example one of the first, second or third sections illustrated in FIGS. 2-14, will be described herebelow.

The preferred embodiment of the process includes various steps. The first step a) includes providing a resin for molding. The next step b) includes embedding at least one reinforcement member within the resin. The next step c) includes molding the capping board section from the resin so as to make a main body and at least one projection extending longitudinally outward from the main body, and so that each reinforcement member is located at least partially within the main body and the corresponding projection.

Optionally, there is an additional step performed between steps a) and b), which includes embedding and/or wetting some reinforcement fibers within the resin. This may facilitate the embedding of the reinforcement members within the resin.

When making the assembly 20, one may mold a first capping board section 100 and mold a second capping board section 200 so that the sections may be connected by an interlocking joint 400 including a projection and an recess. A third capping board section 300 may then be molded, independently or together with the other sections, for the assembly.

By "molding" it should be understood that the sections are made from a polymeric material by any conventional casting method known to a person skilled in the art.

Figure 17:
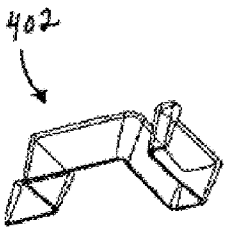
FIG. 17 is a perspective view of an edge spacer for use in a mold for manufacturing the sections of the capping board according to one embodiment of the present invention.

Referring now to FIG. 17, existing molds for molding capping boards may be modified to produce sections for capping boards by introducing an edge spacer 402. The edge spacer, which is preferably metallic, is inserted and incorporated into the mold (not illustrated) to define two distinct mold portions and to form the respective capping board sections (not illustrated here). The spacer thus defines the shape of the interlocking joint by allowing the resin to form the required projections and recesses. The mold may also be adapted in length to account for the edge spacer's 402 thickness, if desired.

The edge spacer 402 may have a variety of forms depending on the particular interlocking joint to be produced. In manufacturing three capping board sections, two edge spacers may be used in a single mold for producing three separate sections. Thus, many edge spacers may also be used in a same mold to define a multitude of mold portions.

Alternatively, for certain suitable resin materials the entire capping board may be cast and then cut to thereby separate distinct sections and form the interlocking joint(s). The sections may be cut using a high precision device, such as a laser or a water jet cutting machine.

It should be understood that the invention is not limited to the above described and illustrated embodiments, but includes other embodiments to which many modifications and alterations may be made without departing from what has actually been invented in the present case.

What is claimed is:

1. A capping board assembly for use in an electrolytic cell, comprising:

at least two capping board sections, each having a main body molded of a resin material and seats for supporting respective electrodes;

one of the sections having at least one projection extending longitudinally outward from the main body thereof, and having a reinforcement member embedded at least partially within the main body and the corresponding projection; and the other of the sections having at least one recess provided at an extremity of the main body thereof, each recess mating with the corresponding projection to thereby secure the capping board sections in a functional arrangement, said at least one recess defining at least one adjacent projection having at least one of the seats provided thereon.

2. The capping board assembly of claim 1, wherein one of the at least one projections and the corresponding recess have corresponding shapes enabling the projection to completely fill the corresponding recess when mated therewith.

3. The capping board assembly of claim 1, wherein the at least one projection of one of the sections comprises two projections in spaced relation to each other and defining a recess therebetween, said recess mating with a corresponding projection of the other section, each of the projections having a corresponding reinforcement member at least partially embedded therein.

4. The capping board assembly of claim 3, wherein each of the reinforcement members comprises an elongate portion and a tip, the elongate portion being at least partially located in the corresponding main body and the tip being at least partially located in a corresponding one of the at least one projection, the tip being wider than the elongate portion.

5. The capping board section of claim 4, wherein the tip has a dovetail shape.

6. The capping board assembly of claim 4, wherein, once the two sections are assembled, the tip of the reinforcement member of one of the sections longitudinally overlaps the tip of the other of the sections.

7. The capping board assembly of claim 3, wherein the two projections comprise a center projection extending from between the lateral edges of the main body and an edge projection aligned with one of the lateral edges of the main body.

8. The capping board assembly of claim 3, wherein the two projections extend from a same edge of the capping board section.

9. The capping board assembly of claim 8, wherein the two projections are generally parallel with respect to each other.

10. The capping board assembly of claim 9, wherein the two projections are longitudinally offset with respect to each other.

11. The capping board assembly of claim 1, wherein the at least two sections comprise three sections that are assembled longitudinally in series by mating the projections with the corresponding recesses.

12. The capping board assembly of claim 1, wherein the at least one projection comprises two projections and the at least one recess comprises two corresponding recesses.

13. The capping board assembly of claim 1, wherein the seats of each of the capping board sections comprise a first row of seats on one lateral side of each section and a second row of seats on the other lateral side of each section.

14. The capping board assembly of claim 13, wherein the first and second rows of seats are staggered with respect to each other.

15. The capping board assembly of claim 14, wherein the at least one projection comprises two staggered projections and the at least one recess comprises two corresponding staggered recesses.

16. The capping board assembly of claim 1, wherein the at least one projection extends longitudinally with respect to the main body of the capping board section.

17. The capping board assembly of claim 1, wherein the at least one projection comprises multiple projections and all of the multiple projections extend longitudinally with respect to the main body of the capping board section.

18. The capping board assembly of claim 1, wherein the at least one projection comprises first and second projections extending in spaced relation to each other and defining two recesses on the one capping board section, said two recesses being matable with two corresponding projections of the other capping board section.

19. The capping board assembly of claim 18, wherein all of the projections having a corresponding reinforcement member embedded therein.

20. The capping board assembly of claim 19, wherein each of the capping board sections has an abutment edge for abutting against the other capping board section.

21. The capping board assembly of claim 20, wherein the abutment edge has a zigzag configuration.

22. The capping board assembly of claim 21, wherein the abutment edge is configured so as to zigzag around the seats provided on the projections.

23. A capping board section for use in an electrolytic cell, comprising:

a main body molded of a resin material;

seats for supporting respective electrodes;

at least one projection extending longitudinally outward from the main body, each projection being for mating with a corresponding recess of an element of the electrolytic cell, for securing the capping board section in a functional arrangement;

a reinforcement member embedded at least partially within the main body and one of the at least one projection, wherein said at least one projection has at least one of the seats provided thereon.

24. The capping board section of claim 23, wherein the element is an other capping board section and wherein assembling the capping board sections results in a capping board assembly.

25. The capping board section of claim 24, wherein the tip is outwardly tapered extending away from the main body.

26. The capping board section of claim 25, wherein the tip has a multiple dovetail shape.

27. The capping board section of claim 24, wherein the tip is composed of epoxy, polyester, vinyl ester, acrylic, polyphenilene sulphide-based alloys, polyurethane or thermoset resins, or combinations thereof.

28. The capping board section of claim 24, wherein the elongate portion is straight and extends along the entire length of the main body.

29. The capping board section of claim 24, wherein the elongate portion is made of pultruded resin material reinforced with glass or cizal fibers or a combination thereof.

30. The capping board section of claim 24, wherein each of the at least one projection has a shape wherein it is wider at a location further away from the main body.

31. The capping board section of claim 30, wherein each of the at least one projection is dovetail shaped.

32. The capping board section of claim 31, wherein the at least one projection comprises first and second projections extending in spaced relation to each other to define a recess therebetween, said recess being matable with a corresponding projection of the other capping board, each of said first and second projections having a corresponding reinforcement member embedded therein.

33. The capping board section of claim 24, wherein the at least one projection is integral with the main body and is composed of the same resin material thereof.

34. The capping board section of claim 33, wherein the reinforcement member is entirely covered by the resin material.

35. The capping board section of claim 23, wherein the reinforcement member comprises an elongate portion and a tip, the elongate portion being at least partially located in the main body and the tip being at least partially located in the projection, the tip being wider than the elongate portion.

36. The capping board section of claim 35, wherein the tip is dovetail shaped.

37. The capping board section of claim 36, wherein the multiple dovetail shaped tip is at least partially located within the main body.

38. The capping board section of claim 23, wherein the resin material of which the main body is composed is polytetrafluoroehtylene, polyester, vinylester, polyurethane, polyphenilene sulphide-based alloys, phenolic resins or a combination thereof.

39. A process for manufacturing at least one capping board section comprising the steps of:

d) providing a resin for molding;

e) embedding at least one reinforcement member within the resin; and f) molding the capping board section from the resin so as to comprise a main body, seats for supporting respective electrodes and at least one projection extending longitudinally outward from the main body, and so that each reinforcement member is located at least partially within the main body and the corresponding projection, and said at least one projection has at least one of the seats provided thereon.

* * * * *